US007506934B1

(12) United States Patent
Tanaka

(10) Patent No.: US 7,506,934 B1
(45) Date of Patent: Mar. 24, 2009

(54) FLOOR CUSHION WITH SEAT BACK

(75) Inventor: Nobuyoshi Tanaka, Kawachinagano (JP)

(73) Assignee: Nam Corporation, Osaka (JP)

( * ) Notice: Subject to any disclaimer, the term of this patent is extended or adjusted under 35 U.S.C. 154(b) by 0 days.

(21) Appl. No.: 11/898,442

(22) Filed: Sep. 12, 2007

(51) Int. Cl.
*B60N 2/02* (2006.01)

(52) U.S. Cl. ..... 297/380; 297/382

(58) Field of Classification Search ..... 5/417; 297/354.13, 255, 256, 250.1, 452.37, 452.27, 297/380, 381, 382, DIG. 6
See application file for complete search history.

(56) References Cited

U.S. PATENT DOCUMENTS 579,337 A * 3/1897 Boniface ..... 4/476
3,259,925 A * 7/1966 Tilles ..... 5/655.9
3,746,392 A * 7/1973 German ..... 297/380
5,190,350 A * 3/1993 Hwang et al. ..... 297/380
5,385,390 A * 1/1995 Freeman et al. ..... 297/380
5,720,518 A * 2/1998 Harrison ..... 297/214
2004/0239165 A1* 12/2004 Levin ..... 297/250.1

FOREIGN PATENT DOCUMENTS

FR 2727081 A1 * 5/1996

* cited by examiner

*Primary Examiner*—Milton Nelson, Jr.
(74) *Attorney, Agent, or Firm*—Wenderoth, Lind & Ponack, L.L.P.

(57) ABSTRACT

A floor cushion with a seat back has excellent ease of storage and is designed to improve heat preservation by adjusting the cushion size to a chair or increasing its fitting property. The floor cushion includes a sheet-like seat portion, a sheet-like seat back portion foldably connected to a rear part of the seat portion, and sheet-like sleeve portions foldably connected to both sides of the seat portion. The sheet-like portion extends at a required length beyond the rear part of the seat portion, and extensions of the respective sleeve portions are attached to the back face of the seat back portion, thereby enabling fixing of the respective extensions and the seat back portion to each other, detachably and in a way to allow positional adjustment with hook-and-loop fasteners.

12 Claims, 7 Drawing Sheets

FLOOR CUSHION WITH SEAT BACK

BACKGROUND OF THE INVENTION

The present invention relates to a floor cushion with a seat back. More specifically, the present invention relates to a floor cushion with a seat back having excellent ease of storage and designed for improving heat preservation by adjusting the cushion size to a chair or increasing its fitting property.

Generally, an air conditioner is operated during the summer season in a place of work, etc. to lower the temperature. However, in case of any excessively high cooling, people sometimes feel a strong coldness at the waist and, especially with women, it was often the case to harm their health with excessive cooling of the waist.

From that point of view, a floor cushion has been proposed that has a seat back for protection against cold. The seat back is provided from both sides toward a rear part of a seat portion, in a way to surround the waist, as disclosed in Japanese Laid-Open Patent Publication No. H9-271428.

However, this conventional floor cushion having the seat back provided standing, in fixed state, from the seat portion, presents problems such as inconvenience of storage, unfit size for mounting on an armchair, impossibility of adjusting to a user's constitution, drop of heat preservation in case of poor fitting, etc.

SUMMARY OF THE INVENTION

The objective of the present invention, realized in view of the above-described problems of a conventional floor cushion with seat back, is to provide a floor cushion with seat back having excellent ease of storage and designed for improving heat preservation by adjusting the cushion size to a chair or increasing its fitting property.

To achieve the above-mentioned objective, the floor cushion with seat back according to a first embodiment of the invention comprises:

a seat portion;

a seat back portion foldably connected to a rear part of the seat portion; and a sleeve portion foldably connected to both sides of the seat portion and extended at required length to behind the seat portion, and is characterized in that an extension of the respective sleeve portions is attached to the back face of the seat back portion, thereby enabling to fix the respective extensions and the seat back portion, or the extensions, to each other, detachably and in a way to allow positional adjustment.

Moreover, to achieve the same objective, the floor cushion with seat back according to a second embodiment of the invention comprises:

a seat portion;

a seat back portion foldably connected to a rear part of the seat portion; and a sleeve portion foldably connected to both sides of the seat portion and extended at required length from the side portions of the seat back portion, and is characterized in that the respective sleeve portions are attached to the seat portion, thereby enabling to fix the respective sleeve portions to the seat portion, detachably and in a way to allow positional adjustment.

In this case, the core material of the floor cushion may be constructed with a layered body of an open-cell foaming resin disposed on the surface side, and a closed-cell foaming resin disposed on the back side.

Furthermore, a deformable back face material composed of a metallic foil, metal sheet, etc. may be disposed.

Still more, a convex supporting portion may be formed on both sides at the bottom end of the seat back portion.

According to the floor cushion of the first embodiment of the invention, by comprising a seat portion, a seat back portion foldably connected to the rear part of the seat portion, and a sleeve portion foldably connected to both sides of the seat portion and extended at required length to behind the seat portion, and by attaching an extension of the respective sleeve portions to the back face of the seat back portion, thereby enabling to fix the respective extensions and the seat back portion, or the extensions, to each other, detachably and in a way to allow positional adjustment, and, according to the floor cushion of the second embodiment of the invention, by comprising a seat portion, a seat back portion foldably connected to the rear part of the seat portion, and a sleeve portion foldably connected to both sides of the seat portion and extended at required length from the side portions of the seat, and, by attaching the respective sleeve portions to the seat portion, thereby enabling to fix the respective sleeve portions to the seat portion, detachably and in a way to allow positional adjustment, it becomes possible to secure excellent ease of storage with a flat exploded state, and change the width of the seat back portion by either positionally adjusting and fixing the extension of the sleeve portion or positionally adjusting and fixing the sleeve portion to the seat portion, thereby enabling the adjustment of the cushion size to a chair, an improved fitting property by adjusting the size to the user's constitution, or improve heat preservation with the provision of the seat back portion and the sleeve portion.

Yet more, by constructing the core material of the floor cushion with a layered body of an open-cell foaming resin disposed on the surface side, and a closed-cell foaming resin disposed on the back side, it becomes possible to not only furnish the surface side of the floor cushion with cushioning property, but also retain shape preservability and elasticity on the back side. In addition, by using such core material with proper softness and elasticity, it becomes possible to form natural curves neatly at the seat back portion and the sleeve portion, further improving the fitting property.

Moreover, by disposing a deformable back face material composed of a metallic foil, metal sheet, etc., it becomes possible to improve heat preservation and shape preservability.

Furthermore, by forming a convex supporting portion on both sides at the bottom end of the seat back portion, it becomes possible, especially, to stabilize the grounding state at the bottom end face of the seat back portion against the seat portion in the case where the seat back portion is designed to be inclined, and set the inclination of the seat back portion in a stable state.

BRIEF DESCRIPTION OF THE DRAWINGS

FIGS. 7A-7C2 show a third embodiment of the floor cushion with seat back according to the present invention, FIG. 7A being a plan view of an exploded state, FIG. 7B1 being a plan view showing an assembled state in which the extension of the sleeve is fixed at a small depth, FIG. 7B2 being a side view for above, FIG. 7C1 being a plan view showing an assembled state in which the extension of the sleeve is deeply fixed, and FIG. 7C2 being a side view for above.

DETAILED DESCRIPTION OF THE INVENTION

Figure 1A:
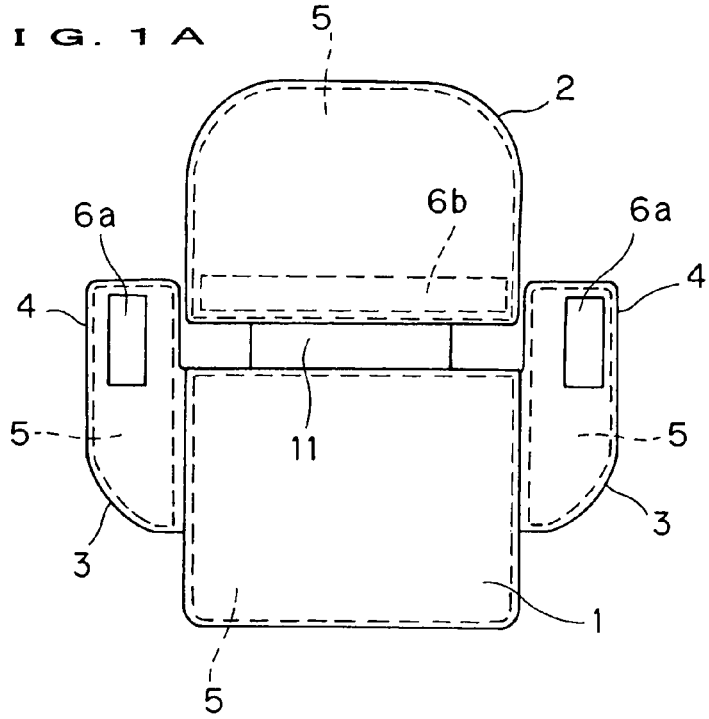
FIGS. 1A-1C show a first embodiment of the floor cushion with seat back according to the present invention, FIG. 1A being a plan view of an exploded state, FIG. 1B being a plan view showing an assembled state in which an extension of the sleeve is fixed at a small depth, and FIG. 1C being a plan view showing an assembled state in which an extension of the sleeve is deeply fixed.

Embodiments of the floor cushion with seat back according to the present invention will be explained below, with reference to the drawings.

FIG. 1A to FIG. 4B show a first embodiment of the floor cushion with seat back according to the present invention.

This floor cushion with seat back comprises a sheet-like seat portion 1, a sheet-like seat back portion 2 foldably connected to the rear part of the seat portion 1, and sheet-like sleeve portions 3 foldably connected to both sides of the seat portion 1 and extending at a required length beyond the rear part of the seat portion 1.

And, this floor cushion with seat back is realized in such a way that an extension 4 of each of the respective sleeve portions 3 is attached to the back face of the seat back portion 2, thereby enabling the respective extensions 4 and the seat back portion 2 to be fixed to each other, detachably and in a way to allow positional adjustment, by means of hook-and-loop fasteners 6*a*, 6*b*.

Though not particularly restricted, the seat portion 1, the seat back portion 2 and the sleeve portions 3 are composed, respectively, of a core material 5 with a thickness of 3 to 4 cm or so covered with a cloth such as furred cloth, etc., and the seat portion 1 and the seat back portion 2 are connected to each other by means of cloth only in a state with a certain interval between the two.

This connecting portion 11 between the seat portion 1 and the seat back portion 2 is formed to be somewhat narrow in width and, together with a width of several centimeters provided in the forward-backward direction, functions as an adjusting portion for fixing the extensions 4 of the sleeve portions 3 either deeply or at a small depth. By forming the connecting portion 11 with a soft cloth, it becomes possible to form the connecting portion 11 over the entire breadth of the seat portion 1 and the seat back portion 2.

Moreover, the seat portion 1 and the sleeve portions 3 are connected to each other also by means of only cloth in a state in which independent core materials 5 are adjacent to each other.

In this embodiment, the length in longitudinal direction of the sleeve portions 3 is 15 to 20 cm, of which the length in longitudinal direction of the extension 4 is set at approximately 10 centimeters. Similarly, the breadth of the seat portion 1 is set at approximately 45 centimeters, and the height of the seat back portion 2 is set at approximately 30 centimeters.

Furthermore, on the back face of the seat portion 1 may be provided an antislipping means such as a rubber coating, etc., as required.

Still more, while, in this embodiment, the seat portion 1 and the seat back portion 2 are connected to each other by means of only cloth, through the connecting portion 11, in a state with a certain interval between the two, and the seat portion 1 and the sleeve portions 3 are connected to each other by means of only cloth in a state in which independent core materials 5 are adjacent to each other, the connecting method is not restricted and it is also possible to connect them detachably and in a way to allow positional adjustment by using hook-and-loop fasteners, for example, and the present invention does not exclude such a connecting method. And, by detachably connecting the seat portion 1, the seat back portion 2 and the sleeve portions 3, it becomes possible to facilitate the change of shape of the seat back portion 2, etc. to be described later, and thus reduce the bulk during storage.

Figures 3A, 3B, 3C:
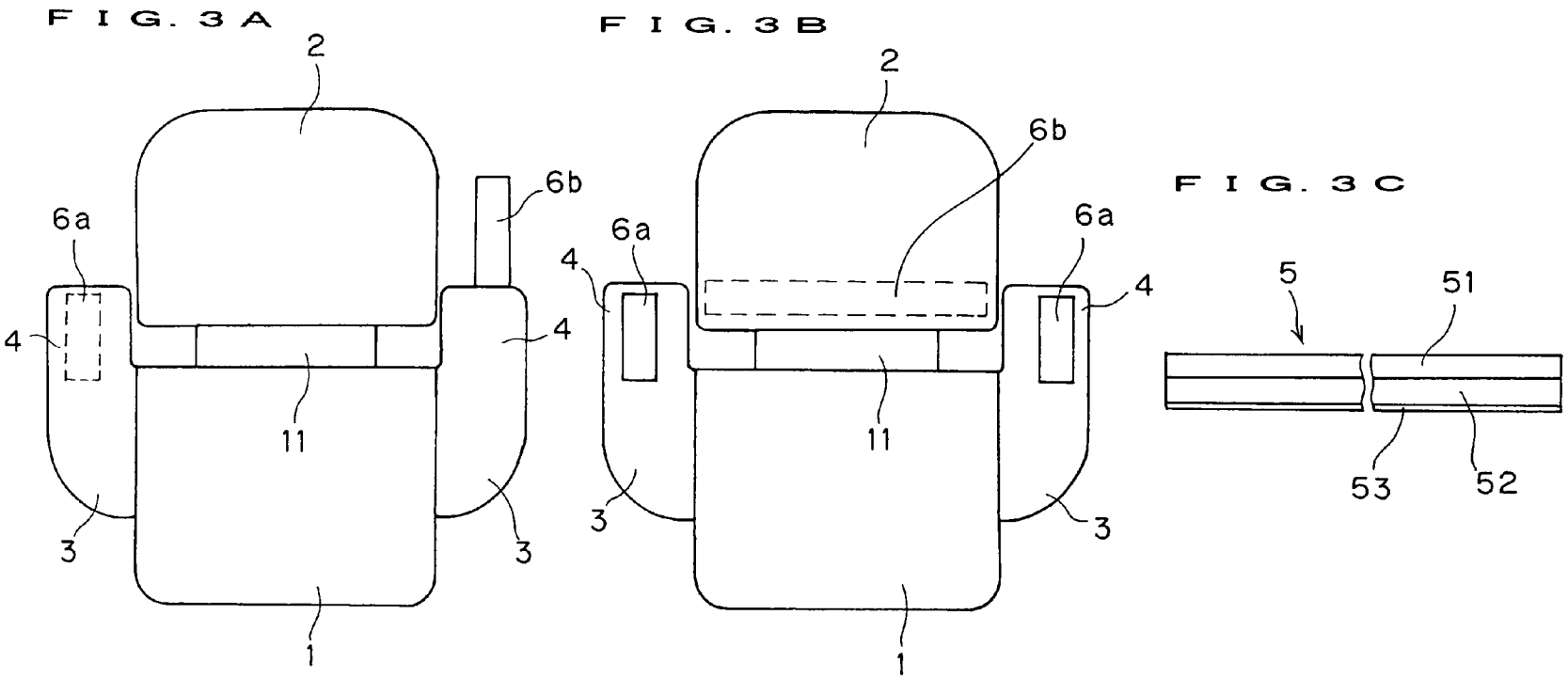
FIGS. 3A-3C show the same floor cushion with seat back, FIG. 3A being an exploded plan view showing an embodiment in which extensions of the sleeve portions are fixed to each other, FIG. 3B being an exploded plan view showing an embodiment in which extensions of the sleeve portions are fixed to the back face of the seat back portion, and FIG. 3C being a sectional view showing an embodiment of core material.

The core materials 5 of the floor cushion are constructed, as shown in FIG. 3C, with a layered body of an open-cell foaming resin 51 disposed on the surface side, a closed-cell foaming resin 52 disposed on the back side, and a thick aluminium foil 53, as a deformable back face material, either pasted or embedded on the back face of the closed-cell foaming resin 52.

As the open-cell foaming resin 51, a polyurethane based resin, for example, may be used suitably, while as the closed-cell foaming resin 52, one may use suitably a polyethylene based resin, for example.

This makes it possible to furnish the surface side of the floor cushion with a cushioning property, retain shape preservability and elasticity on the back side, and, in addition, improve heat preservation and shape preservability by disposing an aluminium foil 53 on the back face.

The aluminium foil 53, as the deformable back face material for furnishing the floor cushion with heat preservation and shape preservability, may be made of another metallic foil, metal sheet, etc., and may also be constructed separately from the core materials 5 or disposed in a state covered with a cloth together with the core materials 5.

And, by disposing this deformable back face material made of metallic foil, metal sheet, etc., the construction of furnishing the floor cushion with heat preservation and shape preservability can also be applied to general floor cushions other than the floor cushion with seat back according to the present invention.

Furthermore, by suitably using soft and elastic core materials 5, as described above, it becomes possible to form natural curves neatly for the seat back portion 2 and the sleeve portions 3, in the assembled state, thereby further improving their fitting property.

Figure 1B:
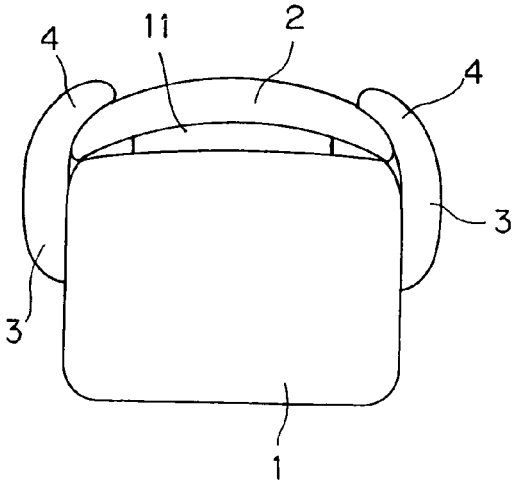

The fixing of the extensions 4 of the sleeve portions 3 with the seat back portion 2 can be made, though not particularly restricted, by means of hook-and-loop fasteners 6*a* fixed on the surface of the sleeve portions 3 and a hook-and-loop fastener 6*b* fixed on the back face of the seat back portion 2, as shown in FIG. 1 or FIG. 3B, for example.

Still more, as shown in FIG. 3A, the extensions 4 of the sleeve portions 3 may also be fixed by means of hook-and-loop fasteners 6*a*, 6*b*, at the extensions 4, turned to the back face of the seat back portion 2, to connect to each other.

Figure 1C:
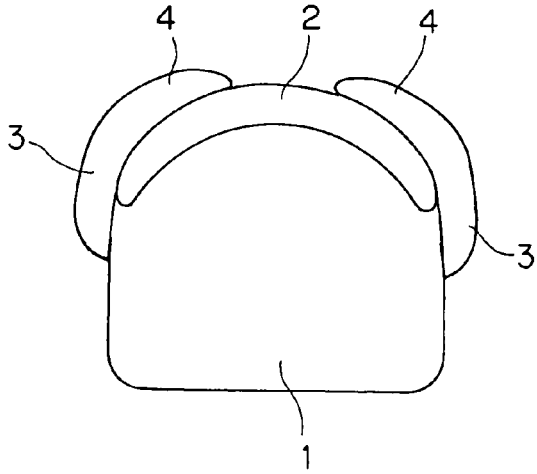

In that case, the width of the chair becomes smaller if the extensions 4 of the sleeve portions 3 are fixed at a deep position, as shown in FIG. 1C, and the width of the chair becomes larger if the fixing is made at a shallow position, as shown in FIG. 3B.

The fixing of the extensions 4 of the sleeve portions 3 may be made, not simply by means of hook-and-loop fasteners 6*a*, 6*b*, but also by using a plurality of hooks, belts, etc.

Yet more, although, in this embodiment, the extensions 4 of the sleeve portions 3 are disposed toward the back face of the seat back portion 2, so that the extensions 4 of the sleeve portions 3 positioned on the back face of the seat back portion 2 may touch the waist or back of the user, to produce an effect similar to that of finger-pressure therapy, the length of the extensions 4 of the sleeve portions 3 may be set as desired.

Figure 4A:
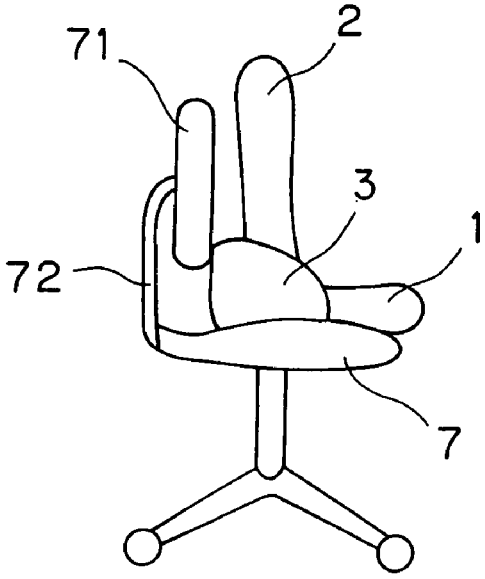
FIGS. 4A and 4B show an example of mounting of the same floor cushion with seat back on a chair, FIG. 4A being a side view showing a state in which the cushion is simply placed on the chair, and FIG. 4B being a side view showing a state in which the seat back portion is fixed to the seat back arm of the chair by means of a string.

Moreover, in the case where this floor cushion with seat back is installed on a chair 7, there may be cases where a gap is produced between the seat back portion 2 and the seat back 71 of the chair, if the floor cushion with seat back is simply placed on the chair 7, as shown in FIG. 4A.

Figure 4B:
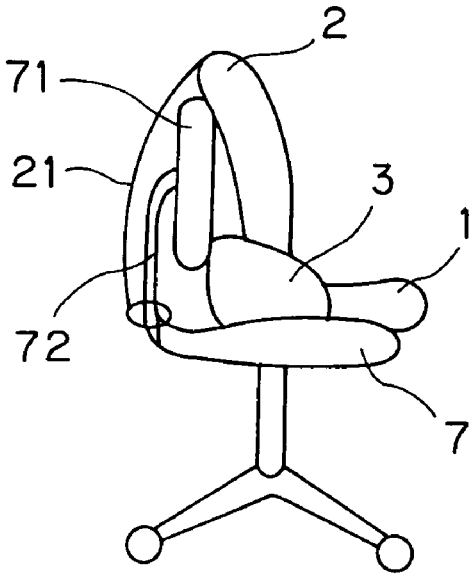
Figure 5A:
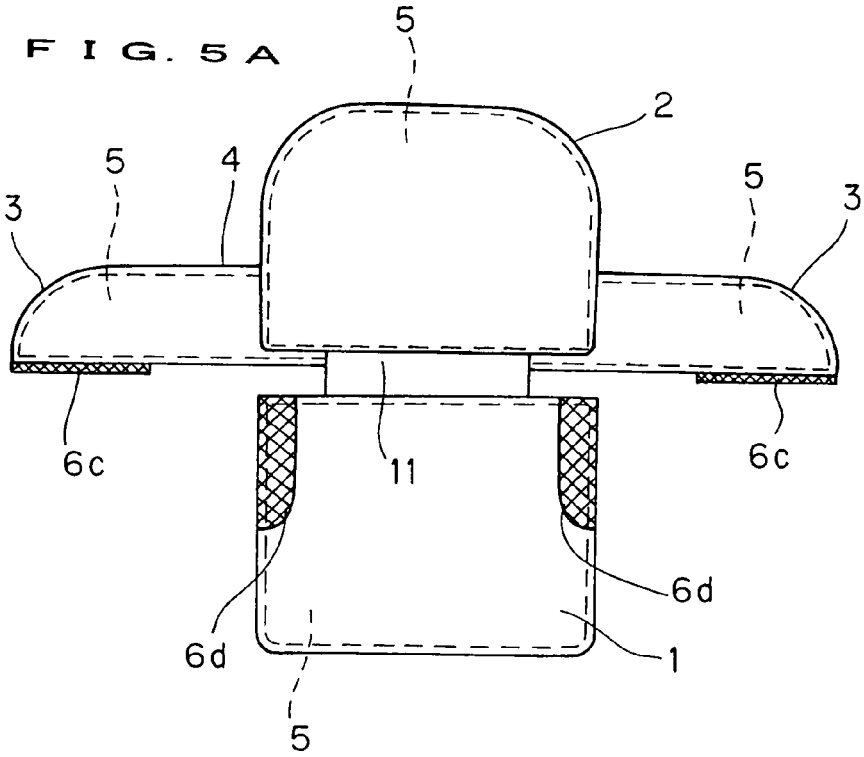
FIGS. 5A-5C show a second embodiment of the floor cushion with seat back according to the present invention, FIG. 5A being a plan view of an exploded state, FIG. 5B being a plan view showing an assembled state in which the extension of the sleeve is fixed at a small depth, and FIG. 5C being a plan view showing an assembled state in which the extension of the sleeve is deeply fixed.
Figure 5B:
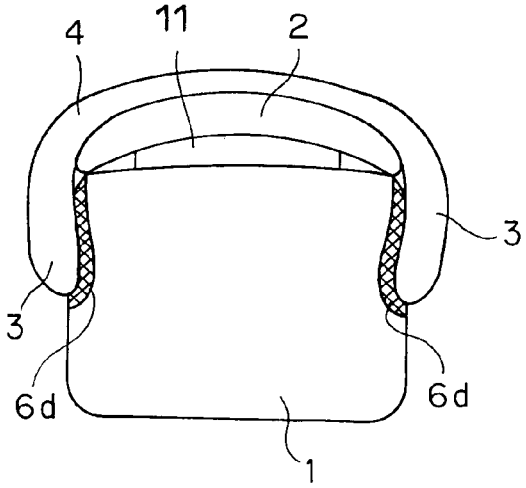
Figure 5C:
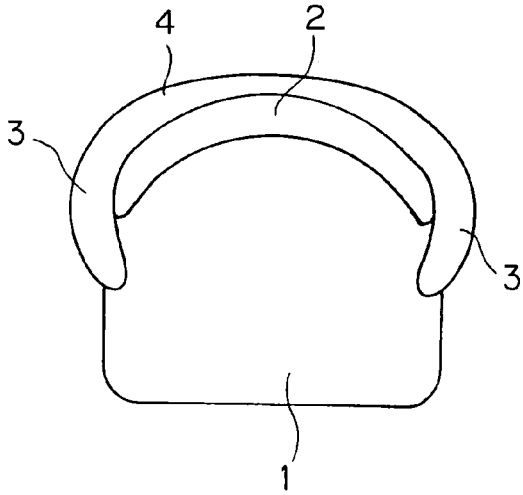
Figure 6A:
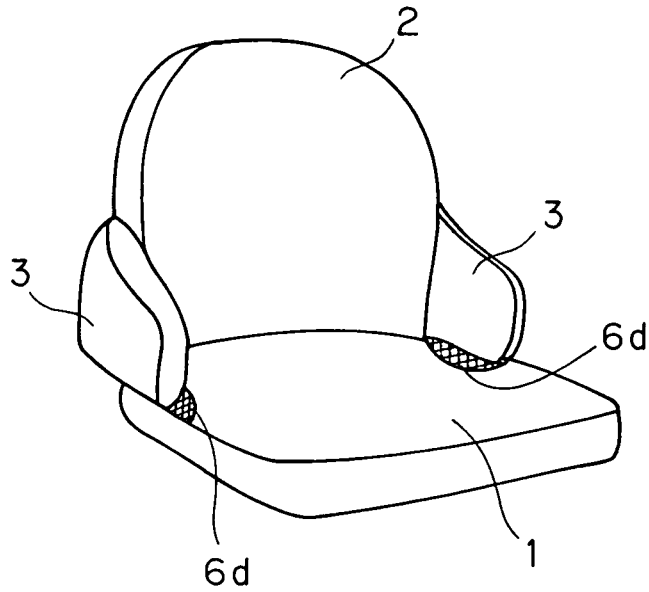
FIGS. 6A-6C show the same floor cushion with seat back, FIG. 6A being a perspective view, FIG. 6B being a side view, and FIG. 6C being a back face view.
Figure 6B:
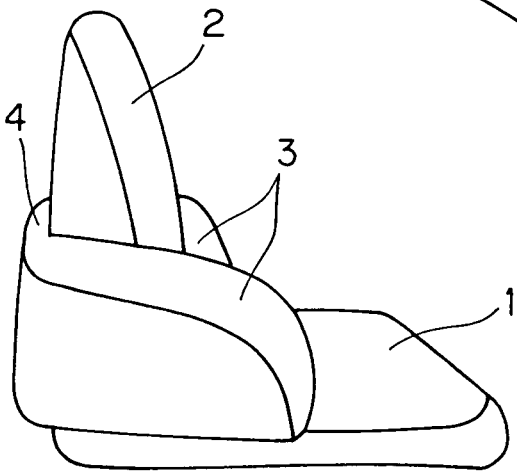
Figure 6C:
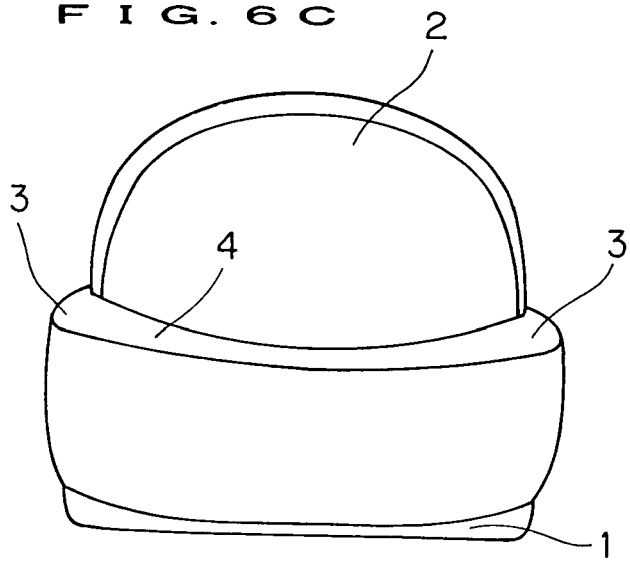

For that reason, a string 21 is provided at the top of the seat back portion 2, and this string 21 is fixed to the seat back arm 72 from above the seat back 71 of the chair, as shown in FIG. 4B, thereby causing the seat back portion 2 to be pulled backward, to keep the floor cushion with seat back in good shape and also stabilize the state of installation of the floor cushion with seat back on the chair 7.

As described above, the floor cushion with seat back according to this embodiment comprises a seat portion 1, a seat back portion 2 foldably connected to the rear part of the seat portion 1, and sleeve portions 3 foldably connected to both sides of the seat portion 1 and extending at a required length beyond the rear part of the seat portion 1, and extensions 4 of the respective sleeve portions 3 are attached to the back face of the seat back portion 2, thereby enabling the fixing of the respective extensions 4 to the seat back portion 2 or the extensions 4 to each other, detachably and in a way to allow positional adjustment. Therefore, the floor cushion has excellent ease of storage by becoming flat in an exploded state, and enables the width of the seat back portion 2 to be changed by positionally adjusting and fixing the extensions 4 of the sleeve portions 3, thereby enabling improved heat preservation, especially heat preservation around the waist, by adjusting the size to a size suitable for installation on a chair, adjusting the size to the user's constitution for better fitting property, and also with the provision of the seat back portion 2 and the sleeve portions 3.

Furthermore, by constructing the core material 5 of the floor cushion with a layered body of an open-cell foaming resin 51 disposed on the surface side, and a closed-cell foaming resin 52 disposed on the back side, it becomes possible to not only furnish the surface side of the floor cushion with cushioning property, but also retain shape preservability and elasticity on the back side and, in addition, by using such core material 5 of proper softness and elasticity, it becomes possible to form natural curves neatly at the seat back portion 2 and the sleeve portion 3, further improving the fitting property.

Still more, by disposing a deformable back face material composed of a metallic foil 53, etc., it becomes possible to improve heat preservation and shape preservability.

FIG. 5A-FIG. 6C indicate a second embodiment of the floor cushion with seat back according to the present invention.

This floor cushion with seat back comprises a sheet-like seat portion 1, a sheet-like seat back portion 2 foldably connected to the rear part of the seat portion 1, and sheet-like sleeve portions 3 extended at a required length from the side part of the back portion 2.

And, this floor cushion with seat back is realized in such a way that the respective sleeve portions 3 are attached to the seat portion 1, thereby enabling to fix the respective sleeve portions 3 to the seat portion 1, detachably and in a way to allow positional adjustment by means of hook-and-loop fasteners 6*c*, 6*d* disposed on the respective sleeve portions 3 and the seat portion 1.

In this embodiment, the hook-and-loop fasteners 6*c*, 6*d* disposed on the respective sleeve portions 3 and the seat portion 1 are realized in a way to allow the respective sleeve portions 3 to be fixed to the surface of the seat portion 1. However, it may also be acceptable to fix the respective sleeve portions 3 to the side face of the seat portion 1.

Yet more, in this embodiment, extensions 4 of the sleeve portions 3 extended at a required length from the side portions of the seat back portion 2 are disposed over the entire back face of the seat back portion 2, so that the extensions 4 of the sleeve portions 3 positioned on the back face of the seat back portion 2 may touch the waist or back of the user, to produce an effect similar to that of finger-pressure therapy, and the sleeve portions 3 may also be extended simply from the side portions of the seat back portion 2.

The sleeve portions 3 may also be fixed to the seat portion 1, and extended at required length from the side portions of the seat back portion 2.

In this way, the floor cushion with seat back according to this embodiment comprises a seat portion 1, a seat back portion 2 foldably connected to the rear part of the seat portion 1, and sleeve portions 3 extended at required length from the side portions of the seat back portion 2, and the respective sleeve portions 3 are attached to the seat portion 1, thereby enabling fixing of the respective sleeve portions 3 to the seat portion 1, detachably and in a way to allow positional adjustment. Therefore, the floor cushion has excellent ease of storing by becoming flat in an exploded state, and enables the changing of the width of the seat back portion 2 by positionally adjusting and fixing the sleeve portions 3 to the seat portion 1 and positionally adjusting the extensions 4 of the sleeve portions 3, thereby improving heat preservation, especially heat preservation around the waist, by adjusting the cushion size to a size suitable for installation on a chair, adjusting the size to the user's constitution for better fitting property, and also with the provision of the seat back portion 2 and the sleeve portions 3.

Other constructions and actions of this embodiment are the same as those of the floor cushion with seat back of the first embodiment described earlier.

Figure 2A:
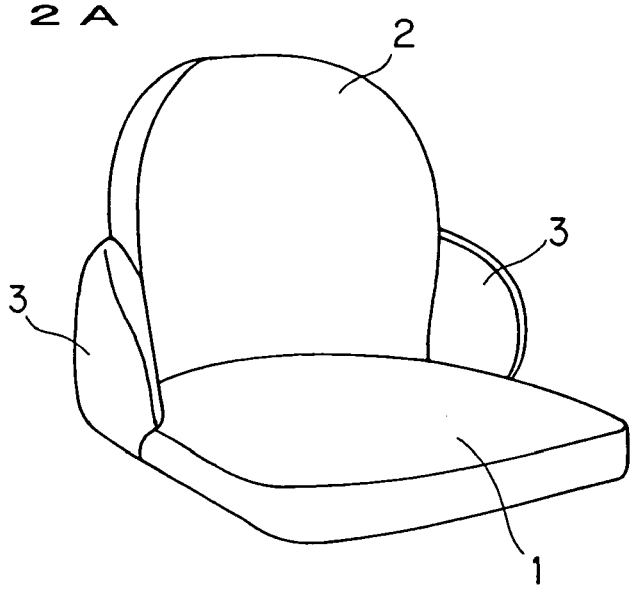
FIGS. 2A-2C show the same floor cushion with seat back, FIG. 2A being a perspective view, FIG. 2B being a side view, and FIG. 2C being a back face view.
Figure 2B:
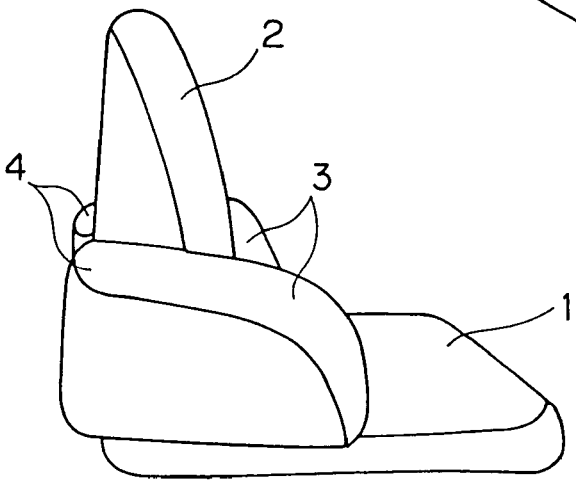
Figure 2C:
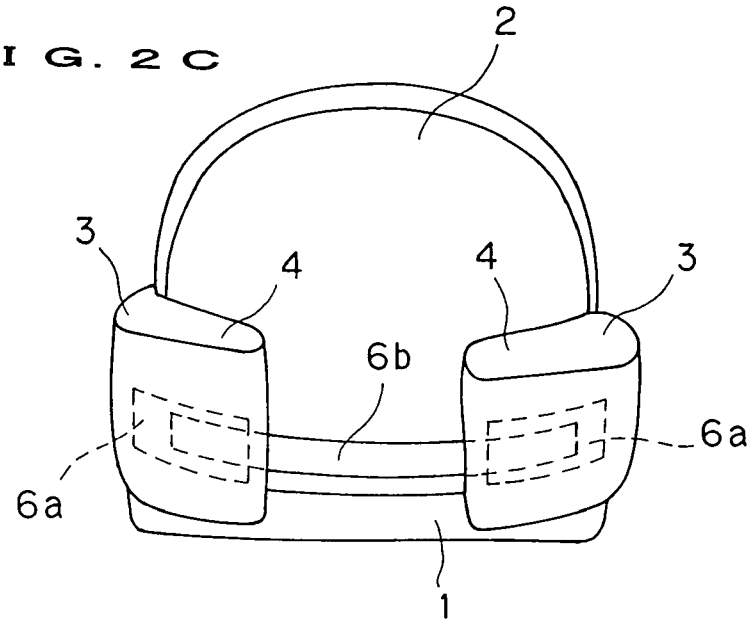
Figure 7A:
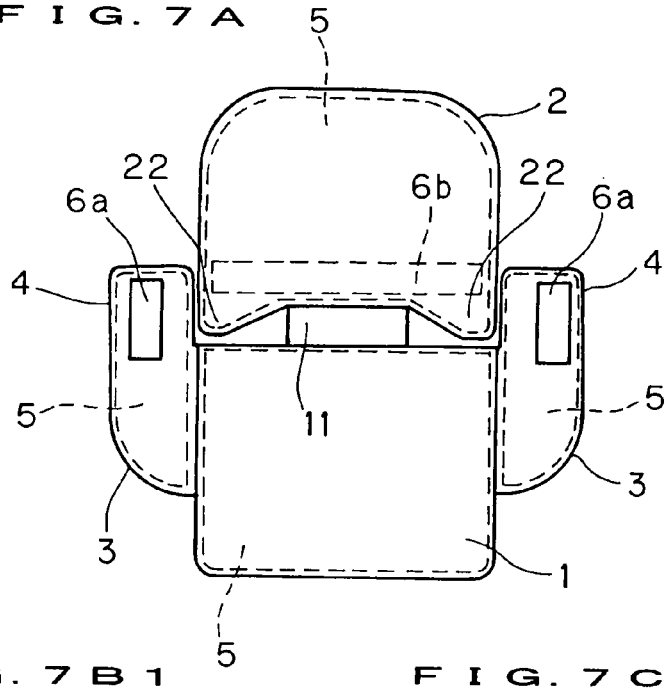
Figure 7A:
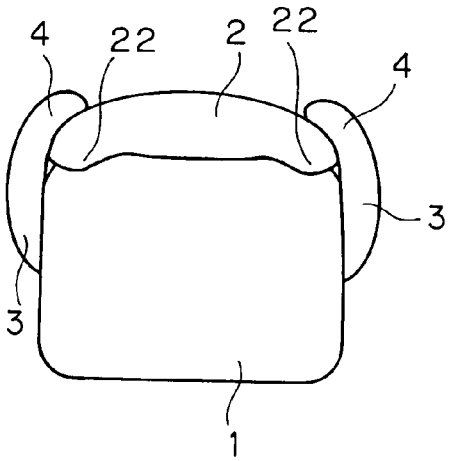
Figure 7A:
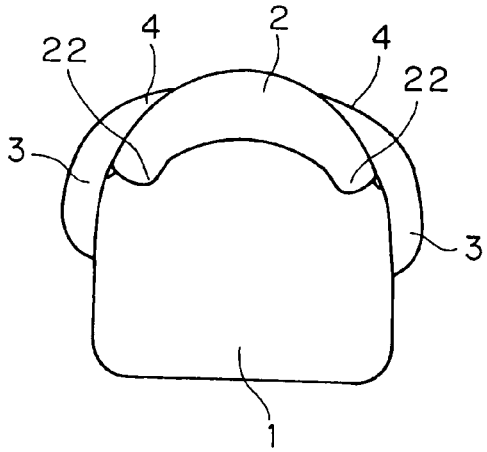
Figure 7A:
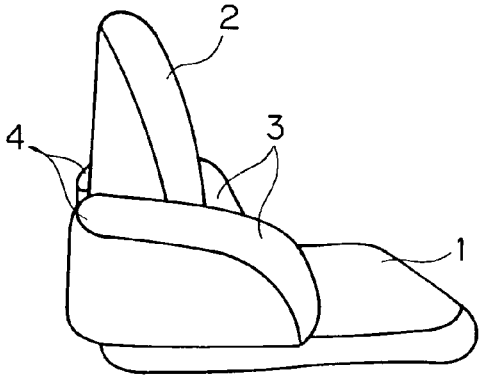
Figure 7A:
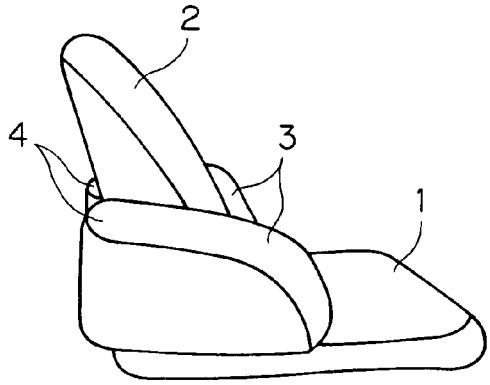

FIGS. 7A-7C2 show a third embodiment of the floor cushion with seat back according to the present invention.

This floor cushion with seat back comprises a sheet-like seat portion 1, a sheet-like seat back portion 2 foldably connected to the rear part of the seat portion 1, and sheet-like sleeve portions 3 foldably connected to both sides of the seat portion 1 and extended at required length to behind the seat portion 1.

And, this floor cushion with seat back is realized in such a way that extensions 4 of the respective sleeve portions 3 are attached to the back face of the seat back portion 2, thereby enabling fixing of the respective extensions 4 and the seat back portion 2 to each other, detachably and in a way to allow positional adjustment, by means of hook-and-loop fasteners 6*a*, 6*b*.

In this embodiment, by forming convex supporting portions 22 on both sides at the bottom end of the seat back portion 2, as shown in FIG. 7A, and especially as the grounding surface area at the bottom end face of the seat back portion 2 against the seat portion 1 increases in the case where the seat back portion 2 is set with an inclination, as shown in FIG. 7C1 and FIG. 7C2, the grounding state stabilizes, thus enabling the seat back portion 2 to be set with an inclination in a stable state.

In this way, the floor cushion with seat back according to this embodiment comprises a seat portion 1, a seat back portion 2 foldably connected to the rear part of the seat portion 1, and sleeve portions 3 extended at required length from the side portions of the seat back portion 2, the respective sleeve portions 3 being attached to the seat portion 1, thereby enabling fixing of the respective sleeve portions 3 to the seat portion 1, detachably and in a way to allow positional adjustment. Therefore, the floor cushion has excellent ease of storage by becoming flat in an exploded state, and enables the change of the width of the seat back portion 2 by positionally adjusting and fixing the sleeve portions 3 to the seat portion 1 and positionally adjusting the extensions 4 of the sleeve portions 3, thereby improving heat preservation, especially heat preservation around the waist, by adjusting the cushion size to a size suitable for installation on a chair, adjusting the size to the user's constitution for better fitting property, and also with the provision of the seat back portion 2 and the sleeve portions 3.

Furthermore, by forming convex supporting portions 22 on both sides at the bottom end of the seat back portion 2, the grounding state at the bottom end face of the seat back portion 2 against the seat portion 1, especially in the case where the seat back portion 2 is set with an inclination, stabilizes, thus enabling the seat back portion 2 to be set with an inclination in a stable state.

As described above, explanation has been made of the floor cushion with seat back according to the present invention, based on its embodiments. However, the present invention is not restricted to the constructions described in the above-mentioned embodiments, and may be changed in construction as required within a range not deviating from its essential purpose, by such means as combining the constructions described in the respective embodiments, etc.

For its excellent ease of storage and characteristics of improving heat preservation through adjustment of size to the chair and improvement of fitting property, the floor cushion with seat back according to the present invention can be either installed on the floor for independent use or used suitably as a floor cushion with seat back to be used by mounting on a chair.

The invention claimed is:

1. A floor cushion with seat back comprising:

a seat portion having a rear part;

a seat back portion having a back face and being foldably connected to the rear part of the seat portion; and a pair of sleeve portions foldably connected to opposite sides of the seat portion, each of the sleeve portions having an extension extending beyond the rear part of the seat portion, wherein the extensions of the sleeve portions are detachably attachable to each other or to the back face of the seat back portion to fix the extensions and the seat back portion, thereby enabling positional adjustment, wherein the seat portion, the seat back portion and the sleeve portions each comprise a core material covered by a cloth material, and wherein the seat back portion is foldably connected to the rear part of the seat portion by only the cloth material and the sleeve portions are foldably connected to the opposite sides of the seat portion by only the cloth material.

2. A floor cushion with seat back as defined in claim 1, further comprising a string for attachment of the floor cushion with seat back portion to a chair.

3. A floor cushion with seat back as defined in claim 1, wherein the core material comprises a layered body of an open-cell foaming resin disposed on a surface side, and a closed-cell foaming resin disposed on a back side.

4. A floor cushion with seat back as defined in claim 1, further comprising hook-and-loop fasteners for detachably attaching the extensions of the sleeve portions to each other or to the back face of the seat back portion.

5. A floor cushion with seat back as defined in claim 1, wherein the core material comprises a deformable back face material comprising a metallic foil or a metal sheet.

6. A floor cushion with seat back as defined in claim 1, wherein the seat back portion has a pair of convex supporting portions formed on opposite sides at a bottom end of the seat back portion.

7. A floor cushion with seat back comprising:

a seat portion having a rear part;

a seat back portion having side portions and being foldably connected to the rear part of the seat portion; and a pair of sleeve portions extending from the side portions of the seat back portion, wherein the sleeve portions are detachably attachable to the seat portion to fix the sleeve portions and the seat portion, thereby enabling positional adjustment, wherein the seat portion, the seat back portion and the sleeve portions each comprise a core material covered by a cloth material, and wherein the seat back portion is foldably connected to the rear part of the seat portion by only the cloth material and the sleeve portions are connected to the side portions of the seat back portion by only the cloth material.

8. A floor cushion with seat back as defined in claim 7, wherein the seat back portion has a pair of convex supporting portions formed on opposite sides at a bottom end of the seat back portion.

9. A floor cushion with seat back as defined in claim 7, wherein the core material comprises a layered body of an open-cell foaming resin disposed on a surface side, and a closed-cell foaming resin disposed on a back side.

10. A floor cushion with seat back as defined in claim 7, further comprising hook-and-loop fasteners for detachably attaching the extensions of the sleeve portions to the seat portion.

11. A floor cushion with seat back as defined in claim 7, wherein the core material comprises a deformable back face material including a metallic foil or a metal sheet.

12. A floor cushion with seat back as defined in claim 7, further comprising a string for attachment of the floor cushion with seat back portion to a chair.

* * * * *